United States Patent [19]

Fujiwara et al.

[11] Patent Number: 4,671,081

[45] Date of Patent: Jun. 9, 1987

[54] DEVICE FOR COLLECTING LUBRICATING OIL IN A TURBO-REFRIGERATOR

[76] Inventors: Satoru Fujiwara; Teiichi Mochizuki; Kensaku Maeda; Yutaka Nagashima, all of c/o Ebara Corporation, 11-1, Haneda Asahi-cho, Ota-ku, Tokyo-to, Japan

[21] Appl. No.: 769,030

[22] Filed: Aug. 26, 1985

[30] Foreign Application Priority Data

Feb. 6, 1985 [JP] Japan ..... 60-19899

[51] Int. Cl.[4] ..... F25B 43/02

[52] U.S. Cl. ..... 62/469; 62/84

[58] Field of Search ..... 62/84, 468, 469, 470, 62/471, 472, 473

[56] References Cited

U.S. PATENT DOCUMENTS

| | | | |
|---|---|---|---|
| 3,004,396 | 10/1961 | Endress et al. | 62/84 |
| 3,013,404 | 12/1961 | Endress et al. | 62/84 |
| 3,081,604 | 3/1963 | Namisniak et al. | 62/84 |
| 3,299,655 | 1/1967 | Rayner et al. | 62/469 |
| 3,393,528 | 7/1968 | Endress | 62/84 |
| 3,705,499 | 12/1972 | Mount et al. | 62/84 |
| 4,404,811 | 9/1983 | Mount et al. | 62/84 |
| 4,404,812 | 9/1983 | Zinsmeyer | 62/84 |

*Primary Examiner*—Ronald C. Capossela

*Attorney, Agent, or Firm*—Oblon, Fisher, Spivak, McClelland & Maier

[57] ABSTRACT

A device for collecting lubricating oil in the turbo-refrigerator comprising an evaporator, a condenser, a compressor, a suction vane arranged in front of the compressor to control the amount of refrigerant gas sucked, a mechanism for returning the lubricating oil, which remains in a space located downstream the suction vane, back to an oil reservoir, and a tube for communicating the space located downstream the suction vane with a space on the evaporation surface of the evaporator.

4 Claims, 11 Drawing Figures

DEVICE FOR COLLECTING LUBRICATING OIL IN A TURBO-REFRIGERATOR

BACKGROUND OF THE INVENTION

The present invention relates to a device for separating and collecting lubricating oil solved and mixed in the refrigerant in the turbo-refrigerator.

One of conventional turbo-refrigerators will be described, referring to FIGS. 1A and 1B, in which reference numeral 1 represents an evaporator, 2 a condenser, 3 a compressor, 4 a suction vane, 5 an oil reservoir in which the lubricating oil is contained, and 6 an ejector. In the case of this turbo-refrigerator, the lubricating oil which is solved and mixed in the refrigerant in the evaporator 1 is made into a mist of fine drops by boiling phenomenon in the evaporator 1, is flowed into the suction pipe of the compressor 3, and remains liquid in a space downstream the suction vane 4. The lubricating oil which remains like this is returned to the oil reservoir 5 by means of the ejector, pump (not shown) or the like.

In the case of the conventional turbo-refrigerator, however, the flow speed of the refrigerant gas which is sucked into the compressor 3 is reduced and the amount thereof is also reduced at the time when the turbo-refrigrator is operated under partial load. The amount of the lubricating oil collected from the evaporator 1 is thus decreased, while the amount of the oil left solved in the evaporator 1 is increased. The evaporative pressure of the refrigerant is thus reduced, while the pressure ratio of the compressor 3 is increased thereby causing the ratio of power consumption to be increased. Further, the amount of the lubricating oil collected is reduced, decreasing the lubricating oil in the oil reservoir 5 and causing the sucking action of the oil pump to be hindered. As a result, lubrication is made insufficient and there is fear that the compressor bearings may be broken or damaged.

SUMMARY OF THE INVENTION

The object of the present invention is therefore to provide a device for collecting lubricating oil in the turbo-refrigerator, wherein smooth collection of the lubricating oil solved in the refrigerant can be maintained even at the time when the turbo-compressor is operated under partial load, so that the power consumption ratio of the turbo-compressor can be reduced without lowering the heat transfer performance of the evaporator.

According to the present invention, there is provided a device for collecting lubricating oil in the turbo-refrigerator comprising an evaporator, a condenser, a compressor, a means arranged in front of the compressor to control the amount of refrigerant gas sucked, a means for returning the lubricating oil which remains at a space located downstream the control means to an oil reservoir, and a tube for communicating the space located downstream the control means with a space on the evaporation surface of the evaporator.

BRIEF DESCRIPTION OF THE DRAWINGS

FIGS. 2 through 6 show examples of the lubricating oil collecting device in the turbo-refrigerator according to the present invention, wherein FIGS. 2(A)–6(A) are flow views, while FIGS. 2(B)–6(B) are detailed sectional views, but FIG. 3B is a segmentary perspective view of FIG. 3A and FIG. 5 is intended to have only a flow view.

DESCRIPTION OF THE PREFERRED EMBODIMENTS

Figure 1:
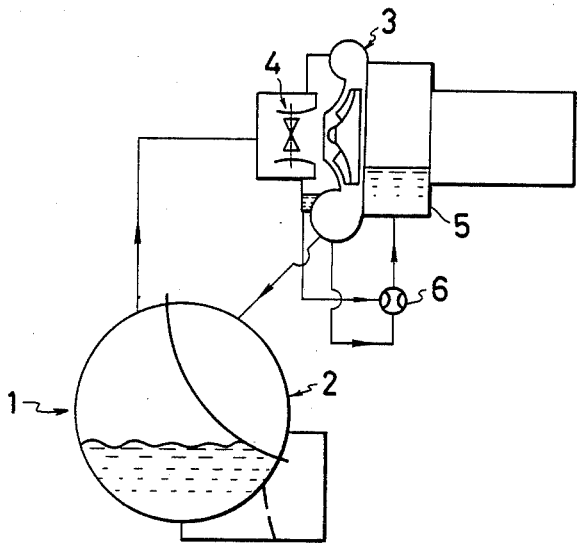
FIG. 1 (A) PRIOR ART
FIG. 1 shows the conventional device for collecting lubricating oil in the turbo-refrigerator.
Figure 1:
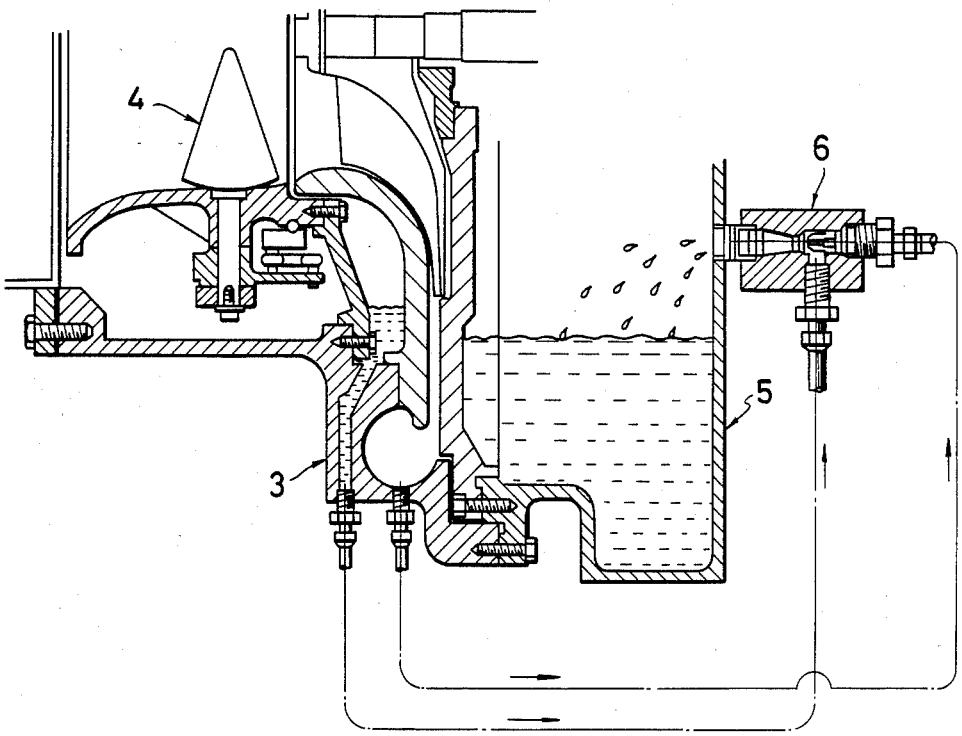
FIG. 1 (B) PRIOR ART

Some embodiments of the present invention will be described referring to the accompanying drawings, wherein similar or corresponding components are designated by like reference numerals throughout the drawings.

When the turbo-refrigerator is operated under partial load, the amount of flowing refrigerant is limited by a suction vane, for example, which serves as a means for controlling the amount of refrigerant sucked. Therefore, the flow speed of refrigerant gas sucked into a compressor is reduced and the amount of refrigerant mist in which lubricating oil is solved, flowing together with the refrigerant gas, is also reduced, causing the amount of the lubricating oil collected to be reduced.

However, pressure on the downstream side of the suction vane is substantially reduced, as compared with that under full load operation. When the turbo-refrigerator is under partial load operation, therefore, the difference between the pressure in a space inside an evaporator and that in a space on the downstream side of the suction vane is increased, causing the flow speed of the refrigerant gas in a communication pipe to be increased. Following this gas flow, the refrigerant in which the lubricating oil is solved can be introduced into the space on the downstream side of the suction vane. A part of this thus-introduced refrigerant in which the lubricating oil is solved is sucked, as refrigerant gas, into the compressor, while the lubricating oil left is collected in a lubricating oil tank chamber by means of an ejector.

An embodiment of the present invention will be described with reference to the drawings.

Figure 2:
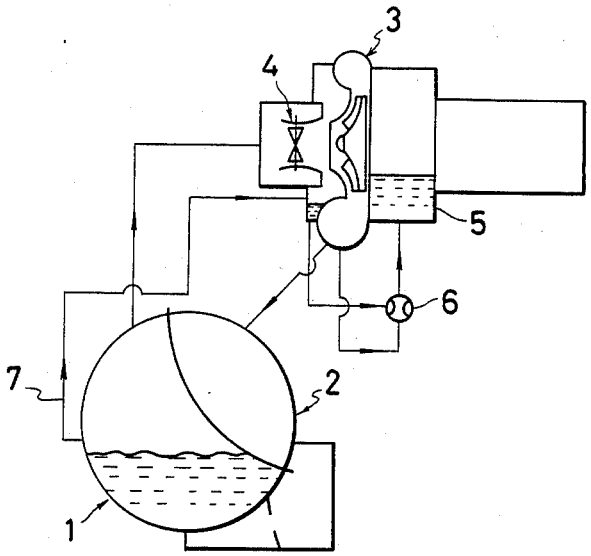
Figure 2:
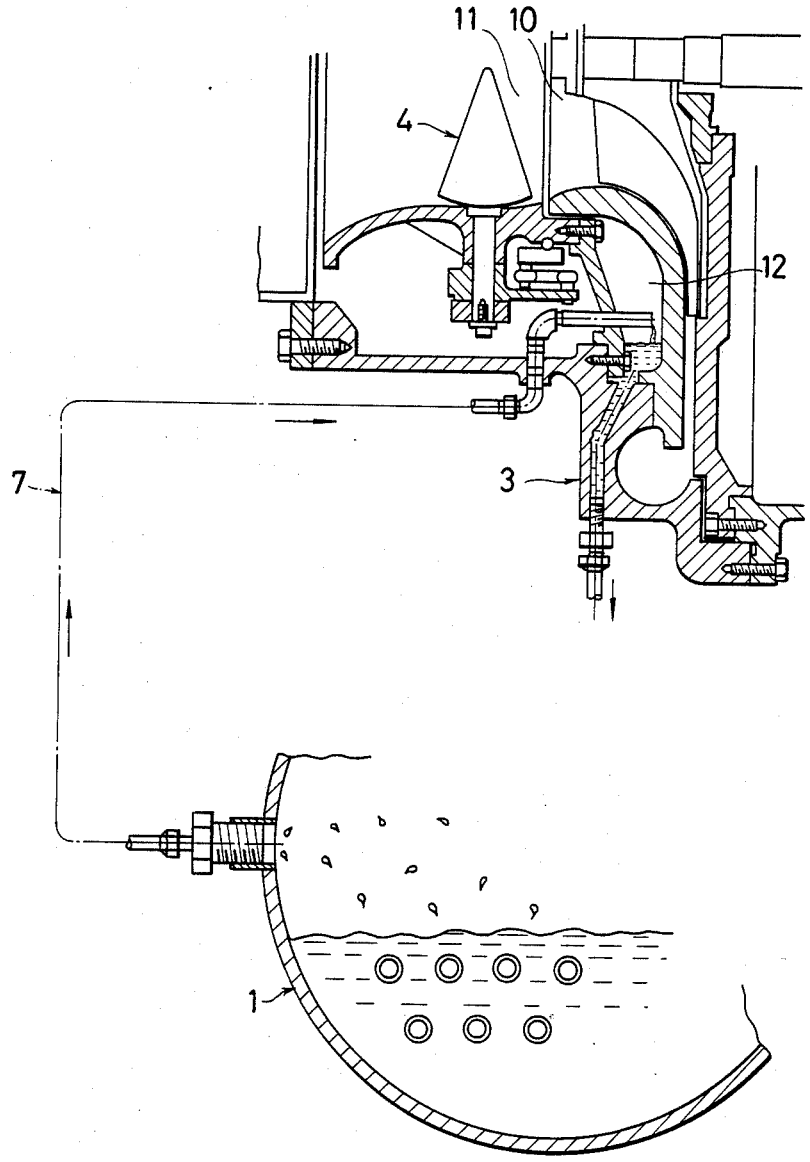

In FIGS. 2A and 2B, reference numeral 7 represents a pipe for connecting on evaporation space in an evaporator 1 with a space on the downstream side of a suction vane 4.

An intermediate space 11 between the suction vane 4 and an impeller entrance 10 or a space 12 communicated with the intermediate space 11 may be selected as the space located on the downstream side of the suction vane. The space 12 has been selected in the case of this embodiment.

Mist and gas of the refrigerant, in which lubricating oil is contained, in the evaporation space of the evaporator 1 are sucked into a compressor 3 on the suction side thereof through the suction vane 4, and the refrigerant gas is compressed by the compressor 3 while the refrigerant mist in which the lubricating oil is contained remains in the space located downstream the suction vane 4. The refrigerant gas which has been compressed is liquidized by a condenser 2 and introduced into the evaporator 1 to form the so-called refrigeration cycle. On the other hand, the lubricating oil which remains in the space 12 downstream the suction vane 4 is collected in an oil reservoir 5 by an ejector 6 which uses a part of compressed gas.

When the turbo-compressor is shifted from full load operation to partial operation, however, a difference between the pressure in the evaporation space of the evaporator 1 and that in the space downstream the suction vane 4 is increased and the flow speed of the refrigerant gas in the communicating pipe 7 is also increased, so that the refrigerant in which the lubricating oil is solved can be introduced, following this gas flow, into the space 12 located on the downstream side of the suction vane 4. This refrigerant in which the lubricating oil is solved is heated by heat generated inside the compressor while it remains in the space 12, and it is separated into refrigerant gas and lubricating oil, which is collected into the oil reservoir 5 by the ejector 6. Therefore, smooth collection of the lubricating oil can be achieved even when the turbo-compressor is under partial load operation.

Figure 3:
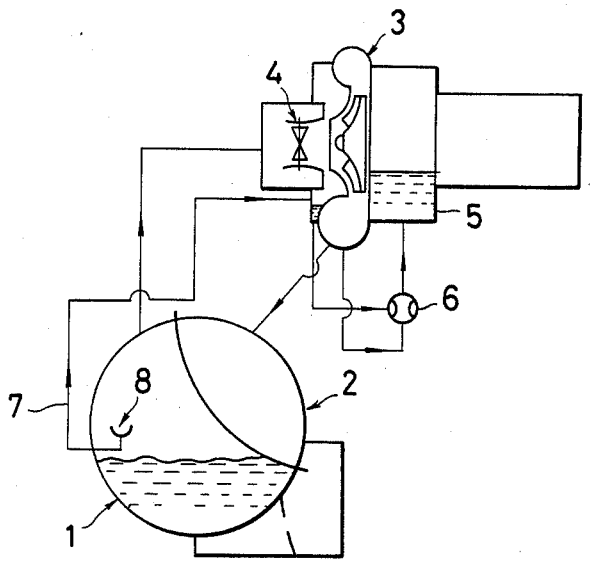
Figure 3:
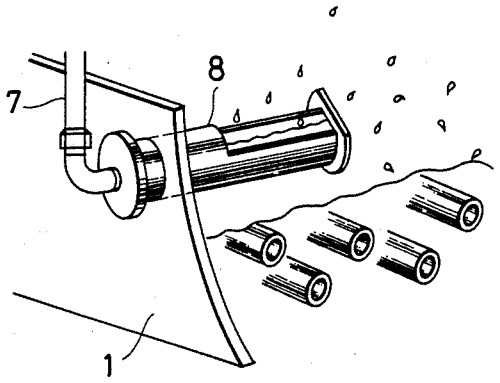

FIGS. 3A and 3B show another embodiment of the present invention, wherein a means 8 for collecting the refrigerant mist in which the lubricating oil is solved is attached to the entrance end of the communicating pipe in the evaporation space of the evaporator 1. Since the refrigerant mist which is formed at the time of evaporation and in which the lubricating oil is solved can be collected by this collector means 8, the amount of the oil-solved refrigerant collected through the communicating pipe can be made larger, as compared with that in the case of using no collector means.

Figure 4:
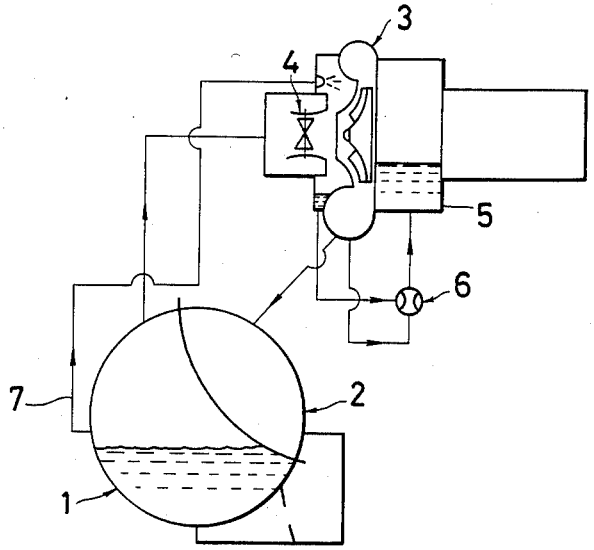
Figure 4:
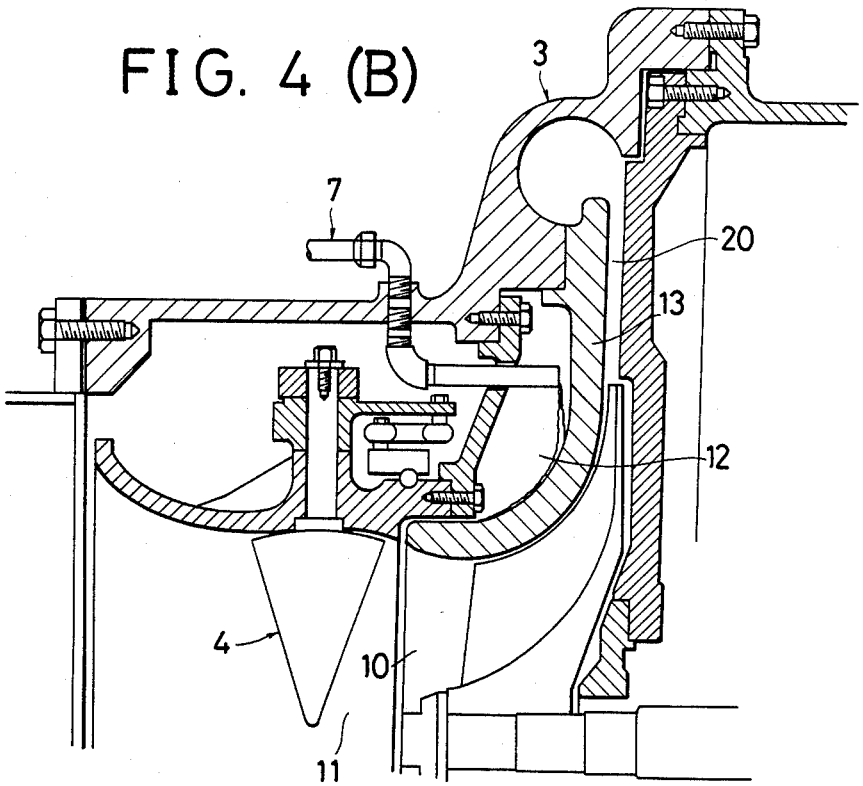

FIGS. 4A and 4B show a further example of the oil collecting device according to the present invention, wherein fluid in the pipe which communicates the evaporation space of the evaporator 1 with the space downstream the suction vane 4 is sprayed onto the upper portion of a wall 13 adjacent to a space 20 in which high pressure discharged-gas exists. The refrigerant fluid which contains the lubricating oil is thus heated by the surface of the wall 13 which has been heated to a high temperature by heat from the compressor, to thereby be separated into lubricating oil and refrigerant gas, and the refrigerant gas is sucked into the compressor 3 while the lubricating oil in which a small amount of the refrigerant is solved is returned to the oil reservoir 5 by means of the ejector 6.

Figure 5:
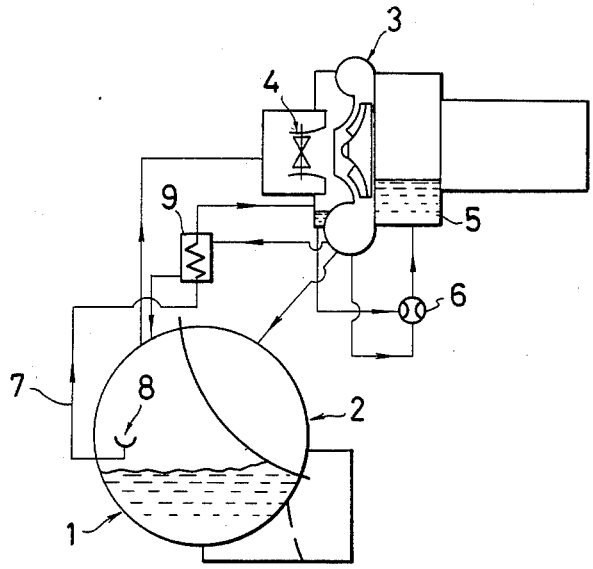

FIG. 5 shows a still further embodiment of the present invention, wherein a heat exchanger 9 is arranged on the way of the communicating pipe 7 shown in FIGS. 2A and 2B and the mist collector means 8 shown in FIGS. 3A and 3B is further attached to one end of the communicating pipe 7.

Figure 6:
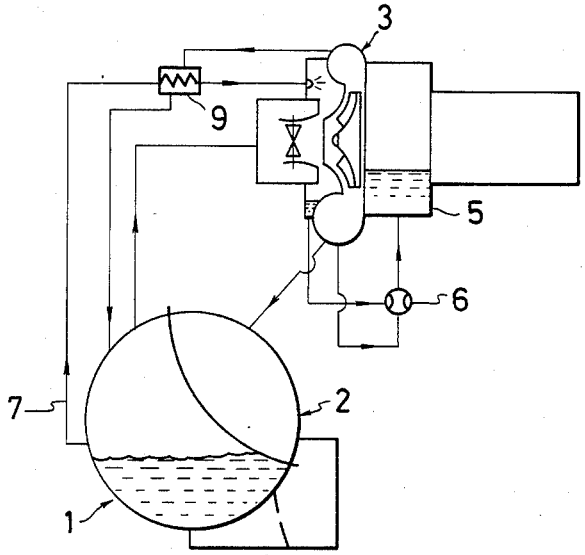
Figure 6:
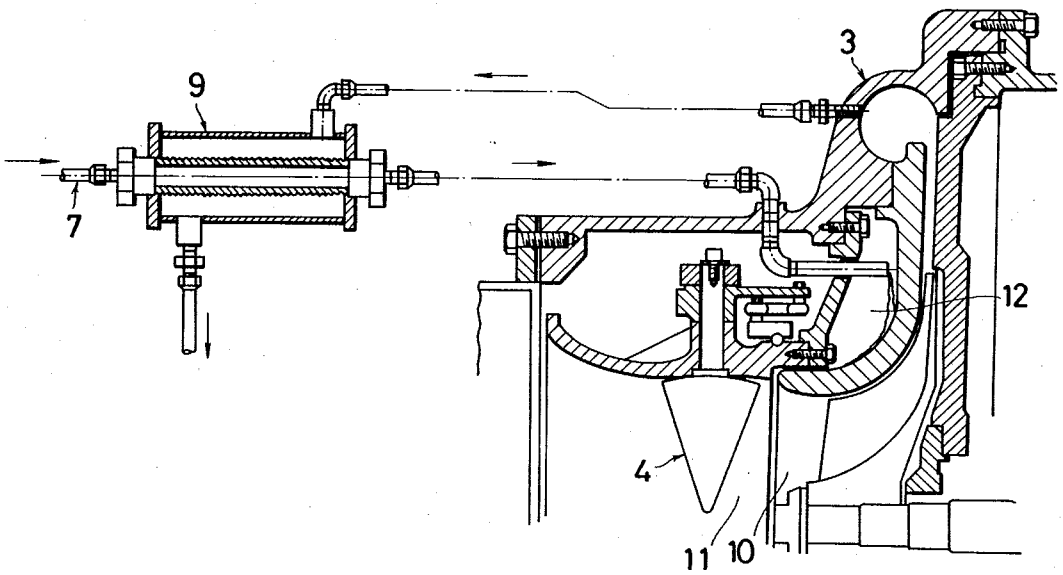

FIGS. 6A and 6B show a still further embodiment of the present invention, wherein a heat exchanger 9 is arranged on the way of the communicating pipe 7 shown in FIGS. 4A and 4B. The heat exchanger 9 uses a part of gas discharged from the compressor, but a single heater or a part of the lubricating oil may be used as its heat source. This embodiment enables the oil-solved refrigerant to be easily separated into refrigerant gas and lubricating oil by arranging the heat exchanger 9 on the way of the communicating pipe 7.

According to the present invention, smooth collection of the lubricating oil which is solved in the refrigerant can be maintained even when the turbo-compressor is under partial load operation, by communicating the space on the evaporation surface of the evaporator with the space located on the downstream side of the refrigerant gas control means through the communicating pipe. Therefore, the heat transmission capacity of the evaporator is not reduced and the pressure ratio of the compressor is increased neither, thereby enabling the power consumption ratio of the turbo-compressor to be reduced. In addition, the smooth oil collection eliminates any possibility that the lubricating oil may become insufficient in the refrigerator, thereby making it possible to provide a turbo-refrigerator which has a highly reliable lubricating line.

Although the present invention has been described with reference to preferred embodiments thereof illustrated in the accompanying drawings, it should be understood that various changes and modifications can be made by those skilled in the art without departing from the scope of the present invention.

What is claimed is:

1. A device for collecting lubricating oil in a turbo-refrigerator comprising an evaporator, a lubricating oil reservoir, a condenser, a compressor having compression means, a control means located between said compressor and said evaporator to control the amount of refrigerant gas sucked into said compressor, and means for returning lubricating oil which remains in a space located on the downstream side of the control means and upstream of said compression means, back to said oil reservoir, and tube means for communicating said space downstream of the control means and upstream of said compression means with an evaporation space of said evaporator.

2. A device according to claim 1 including a container for collecting refrigerant mist in which lubricating oil is solved, said container being positioned in said evaporation space and being connected to said communicating tube means.

3. A device according to claim 1 including a heat exchanger attached to said communicating tube means.

4. A device according to claim 1 including means for causing refrigerant in which the lubricant oil is solved and delivered through said communicating tube means to contact a portion of a member which forms said space and which is heated to high temperature by heat generated by the compressor.

* * * * *